US005651507A

United States Patent [19]

Rüskens et al.

[11] Patent Number: 5,651,507

[45] Date of Patent: Jul. 29, 1997

[54] YARN SPLICING DEVICE FOR BOBBIN-WINDING TEXTILE MACHINES

[75] Inventors: Herbert Rüskens, Wegberg; Leo Tholen, Heinsberg; Siegfried Schatton; Ulrich Wirtz, both of Mönchengladbach; Gregor Rüth, Germany; Joachim Stiller, Mönchengladbach, all of Germany

[73] Assignee: W. Schlafhorst AG & Co., Moenchengladbach, Germany

[21] Appl. No.: 496,765

[22] Filed: Jun. 29, 1995

[30] Foreign Application Priority Data

Jun. 7, 1994 [DE] Germany ..... 44 23 836.3
Mar. 21, 1995 [DE] Germany ..... 195 10 171.5

[51] Int. Cl.[6] ..... B65H 69/04; D01H 11/00

[52] U.S. Cl. ..... 242/35.6 R; 57/22; 57/261

[58] Field of Search ..... 242/35.6 R; 57/22, 57/261

[56] References Cited

U.S. PATENT DOCUMENTS 2,743,877 5/1956 Furst ..... 242/35.6 R
2,769,599 11/1956 Furst ..... 242/35.6 R
3,198,446 8/1965 Furst et al. ..... 57/261 X
4,232,509 11/1980 Rohner et al. ..... 242/35.6 R X
4,844,358 7/1989 Kamp ..... 242/35.6 R X

FOREIGN PATENT DOCUMENTS

3637033A1 5/1988 Germany .
4005752A1 8/1991 Germany .
4231958A1 3/1994 Germany .

OTHER PUBLICATIONS

Schlafhorst, Inc., "Der Spleisserverbindet di Fadenenden", Dec. 1986, 7 pages.

*Primary Examiner*—Michael Mansen
*Attorney, Agent, or Firm*—Shefte, Pinckney & Sawyer

[57] ABSTRACT

A yarn splicing device for textile winding machines comprises a splicer mechanism for pneumatically joining yarn ends, upper and lower clamping and cutting devices, and suction-actuated yarn placement devices for placing the yarn ends to be spliced. According to the invention, one yarn placement device is a gripper tube normally parked in a zero position upstream of the yarn travel. The gripper tube has a spring-biased, pivotable gripping flap and a yarn placement hook for simultaneously placing both the lower yarn and the upper yarn to be spliced. For that purpose, one of the gripper tube and gripper tube flap carries the yarn placement hook forwardly for manipulating the upper yarn and a yarn guide disposed between the yarn placement hook and the pivot axis of the flap for placing the lower yarn.

14 Claims, 6 Drawing Sheets

YARN SPLICING DEVICE FOR BOBBIN-WINDING TEXTILE MACHINES

FIELD OF THE INVENTION

The present invention relates to a yarn splicing device for textile winding machines that produce cross-wound bobbins and particularly to such machines having a splicer disposed outside the normal path of yarn travel during winding for pneumatically joining yarn ends, clamping and cutting devices disposed in the region of the splicer, suction-actuated yarn positioning devices for placing the yarn ends to be spliced, and means for inserting the yarn ends into the splicer.

BACKGROUND OF THE INVENTION

Pneumatic yarn splicing devices of the basic type identified above are disposed as a rule in stationary fashion at the work stations of automatic bobbin winding machines, as is known from numerous publications such as German Patent Disclosures DE 36 37 033 A1 or DE 40 05 752 A1. The design and function of such yarn splicing devices is also described at length in the manual entitled "Autoconer 238" by the Schlafhorst Corporation.

In such devices, an automatic yarn joining and/or cop changing mechanism is activated via the computer of the affected winding station in the event of a yarn break and when it is necessary to change the feed cop or bobbin which delivers the yarn being wound. More specifically, a suction nozzle is first placed against the surface of the takeup bobbin being wound, which is rotating slowly counter to the winding direction. Once the upper yarn end trailing from the takeup bobbin has been engaged, the suction nozzle pivots back to its original starting position, in which the suction nozzle opening is positioned below the splicer. In the process, the length of yarn extending between the takeup bobbin and the suction nozzle is drawn into an electronic cleaner located above the yarn splicing device, a clamping and cutting device positioned in that region, and, under the guidance of corresponding guide contours of yarn guide baffles and yarn guide hoops, into the scissors blades of a cutting device located below the splicer. During this placement process, the upper yarn also slides over the back of a yarn catching hook positioned above the splicer and enters the region of an opened upper yarn clamp.

Virtually simultaneously with the suction nozzle, a gripper tube positioned in a lower starting position pivots into an upper working position and in so doing carries a lower yarn end drawn off the feed cop or bobbin by means of a yarn tensioner with which the yarn end has been held. When the gripper tube pivots into its upper working position, the lower yarn, likewise guided on corresponding yarn guide contours similarly to the upper yarn end, slides into an opened lower yarn clamp, an opened upper cutting device, and a fork-like recess in the yarn catching hook.

The yarn catching hook swivels inwardly to lay the upper and lower yarns into the bottom of the splicing chamber of the pneumatic splicer. The upper yarn is also drawn into the upper yarn clamp in the process. The yarn end fixed in the upper and lower yarn clamps are cut to the correct length in the associated cutting devices and prepared for the ensuing splicing by opening the respective yarn ends in yarn opening tubes. The prepared yarn ends are fed in parallel relation to one another into the splicing chamber, typically in the form of an elongate channel, by special yarn drawing-in devices, and the yarn ends are swirled together pneumatically to accomplish spliced intermingling and twisting of the constituent fibers of the yarn ends.

While the winding station starts up again, the yarn catching hook pivots in a defined fashion back to its original position and in the process slowly releases the spliced yarn.

The above-described devices have proven themselves in practice to produce very good yarn splices. However, these devices have the disadvantage of a relatively expensive and complicated construction.

SUMMARY OF THE INVENTION

Based on yarn joining devices of the basic type described above, an object of the present invention is to further improve such devices by providing a simpler and less expensive construction.

Briefly summarized, the present invention accomplishes this objective by providing an improved yarn splicing device for textile winding machines for producing cross-wound bobbins comprising a splicer unit disposed outside a normal path of yarn winding travel for pneumatically joining yarn ends, means for clamping and cutting yarn ends to be spliced in the region of the splicer, suction-actuated yarn placing means for positioning the yarn ends to be spliced, and means for inserting the yarn ends into the splicer. According to the present invention, the yarn placing means comprises a gripper tube for engaging a first yarn to be spliced and disposed for movement within an operative range including a terminal position wherein the first yarn engaged by the gripper tube is positioned properly in the splicer, the gripper tube having carrier means for engaging a second yarn to be spliced with the first yarn during operative movement of the gripper tube and for carrying the second yarn into proper position in the splicer in the terminal position of the gripper tube.

The described embodiment of the gripper tube for the lower yarn end and its special disposition in the yarn travel path provide the advantage that, when the gripper tube pivots into its upper working position to place the lower yarn, the upper yarn is carried along as well via the carrier means, preferably in the form of a yarn placing hook, and is positioned in the splicer, or the associated yarn preparing devices. Hence, it is unnecessary to use a special yarn catching hook or any associated control and drive mechanism.

According to a further feature of the invention, the gripper tube has a pivotably supported, spring-actuated gripper tube flap disposed on its end and equipped with the yarn placing hook. This gripper tube flap closes the region of the mouth of the gripper tube, whereby an air slide screen heretofore utilized in conventional open gripper tubes in the gripper tube suction connection and the associated mechanism required for actuating the screen can be omitted.

Advantageously, the gripper tube flap has on its front panel the yarn placing hook disposed to extend axially beyond the gripper tube. When the gripper tube is pivoted out of its original starting position into its terminal working position above the splicer, this hook intersects the path of the upper yarn and thus reliably and gently carries the upper yarn along with it.

In a further feature of the invention, the gripper tube flap has a yarn guide device disposed between the pivot axis and the yarn placing hook. This yarn guide device essentially comprises a nose-like protrusion that extends beyond the gripper tube flap, in the direction of pivoting of the flap, and a yarn guide contour adjoining this protrusion at its rear. This configuration of the yarn guide device assures both reliable carrying of the lower yarn (which is laid by an auxiliary gripper in the region of the yarn tensioner and whose length extends between the suction nozzle of a round cop magazine associated with the winder and the spinning cop located in the feed position) and controlled separation of the yarns upon the entry of the gripper tube into its terminal upper working position. The yarn guide contour, which is preferably raised as a ridge-like surface, also prevents the severed yarn end from being mistakenly engaged at the same time by the suction applied to the suction nozzle of the round cop magazine and the suction in the gripper tube.

In the preferred embodiment, a spring element disposed in the region of the pivot axis of the gripper tube flap acts upon the flap in the direction of closure of the gripper tube mouth. The spring element has a relatively soft spring characteristic, so that the gripper tube flap can be kept reliably closed, but upon arrival at a stop disposed in the region of the upper working position can easily be opened. In this manner, it can be assured that the upper yarn and the lower yarn will be reliably separated in the upper working position of the gripper tube.

The partial opening of the gripper tube flap, takes place preferably via a spring-actuated stop disposed in the region of the terminal upper working position of the gripper tube. The stop has a flange-like support element, against which an edge portion of the gripper tube flap engages before the gripper tube itself has reached the stop. In a preferred embodiment, the spring element of the stop has a harder spring characteristic curve than the spring element incorporated between the gripper tube flap and the gripper tube. Such an embodiment has the advantage than when the gripper tube flap arrives at the support element of the stop, pivoting of the gripper tube flap takes place immediately, and hence produces both a separation of the yarns and tautening of the lower yarn. The relatively hard spring characteristic curve of the stop spring element then essentially eliminates any mechanical play involved in the gripper tube drive when the gripper tube strikes the stop so that the gripper tube always precisely reaches the predetermined terminal position.

According to a further feature of the invention, a stationary control element is disposed in a yarn transfer position of the gripper tube, into which the gripper tube pivots in the event of a "normal" yarn break. This stationary control element corresponds with a control cam on the gripper tube flap so that, in the region of the yarn transfer position, the gripper tube flap swivels away from the mouth of the gripper tube and the suction opening is thus uncovered. The suction present at the gripper tube mouth can then engage the lower yarn theretofore held in readiness in the yarn tensioner. Upon subsequent pivoting of the gripper tube toward the terminal upper working position, the control cam slides away from the control element, so that the spring-biased gripper tube flap closes again securely. The resulting quick closure of the gripper tube flap is especially advantageous when troublesome yarns are processed, because such yarns are often difficult to grip pneumatically. By means of the spring-induced closure of the flap, however, the yarns are clamped and thus securely held mechanically.

In an alternative embodiment of the invention, the yarn placing hook is disposed directly at the gripper tube, and extends through a slit-like opening in the gripper tube flap. Such an embodiment has the advantage that, in the lower working position of the gripper tube, i.e., wherein the tube receives the lower yarn, the gripper tube flap sweeps over the entire yarn placing hook as the flap opens and thus automatically cleans the hook of any yarn loops or other adhering yarn residues that may be present. Yarn loops of this kind can develop for instance in the course of a failed attempt at splicing or a yarn break following the splicing operation and can become stuck on the yarn placing hook.

Further details of the invention may be learned from exemplary embodiments discussed in detail below in conjunction with the drawings.

DESCRIPTION OF THE PREFERRED EMBODIMENT

Figure 1:
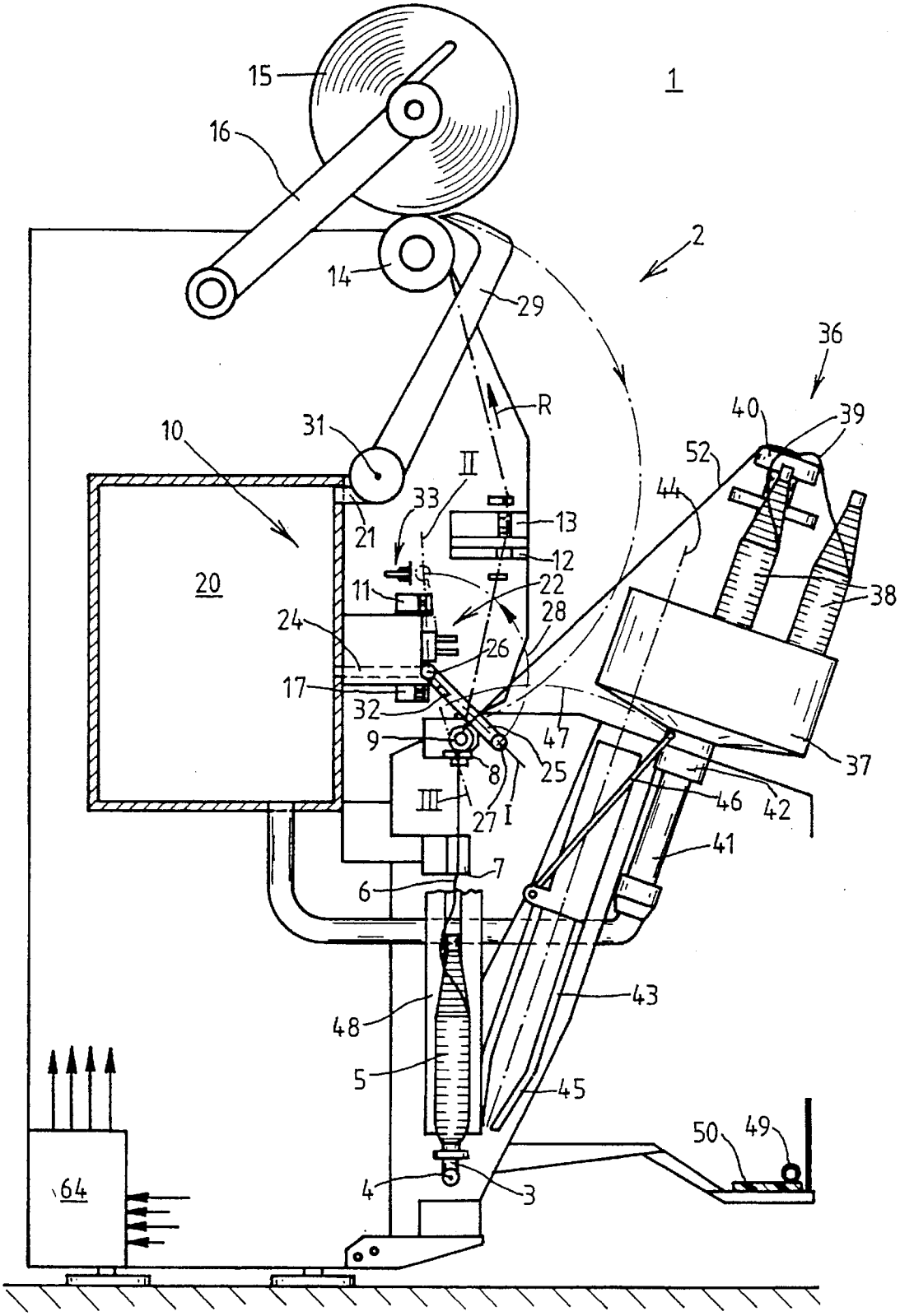
FIG. 1 is a vertical cross-section through a textile bobbin-winding machine equipped with a yarn splicing device according to a preferred embodiment of the present invention, showing one winding station of the machine in side elevation.

Referring now to the accompanying drawings and initially to FIG. 1, a textile winding machine of the basic type which produces cross-wound bobbins, e.g., cones, is indicated in its totality at 1.

Such bobbin winding machines are known to have a number of winding stations 2 disposed side by side along the length of the machine 1. At each of these winding stations, a plurality of relatively small-volume spinning cops are each rewound successively into cross-wound bobbins or cones, which have a considerably larger yarn volume required for subsequent operations.

As shown, a yarn feed cop 5, such as is produced preferably on a ring spinning machine, is positioned at the winding station 2 during the rewinding process on an arbor 3 which is pivotably support about a joint 4. The yarn 6 drawn from the feed cop 5 first passes successively through a feed accelerator 7, a precleaner 8, and a yarn tensioner 9, and then passes forwardly of a yarn splicing device 10, which is set back somewhat with respect to the normal path of yarn travel during the ongoing winding operation. The splicing device 10 is equipped with an upper clamping and cutting device 11 and a lower clamping and cutting device 17. Above the region of the splicing device 10, the yarn 6 also passes through an electronic cleaner 12, and a clamping and cutting device 13 associated with and operatively connected to the cleaner 12. After passing through the cleaner 12, the yarn 6 reaches a winding device, in which the yarn is wound into a bobbin 15 supported by a creel 16 and surface driven frictionally by peripheral engagement with a driven grooved drum 14.

As also shown in FIG. 1, the bobbin winder 1 has a suction conduit 20 which extends substantially the full length of the machine and discharges into a collection chamber (not shown) at one end of the machine. The collection chamber is connected to a source of negative pressure, i.e., suction (likewise not shown), to receive dust and yarn residues suctionally during the ongoing winding operation.

Figure 2:
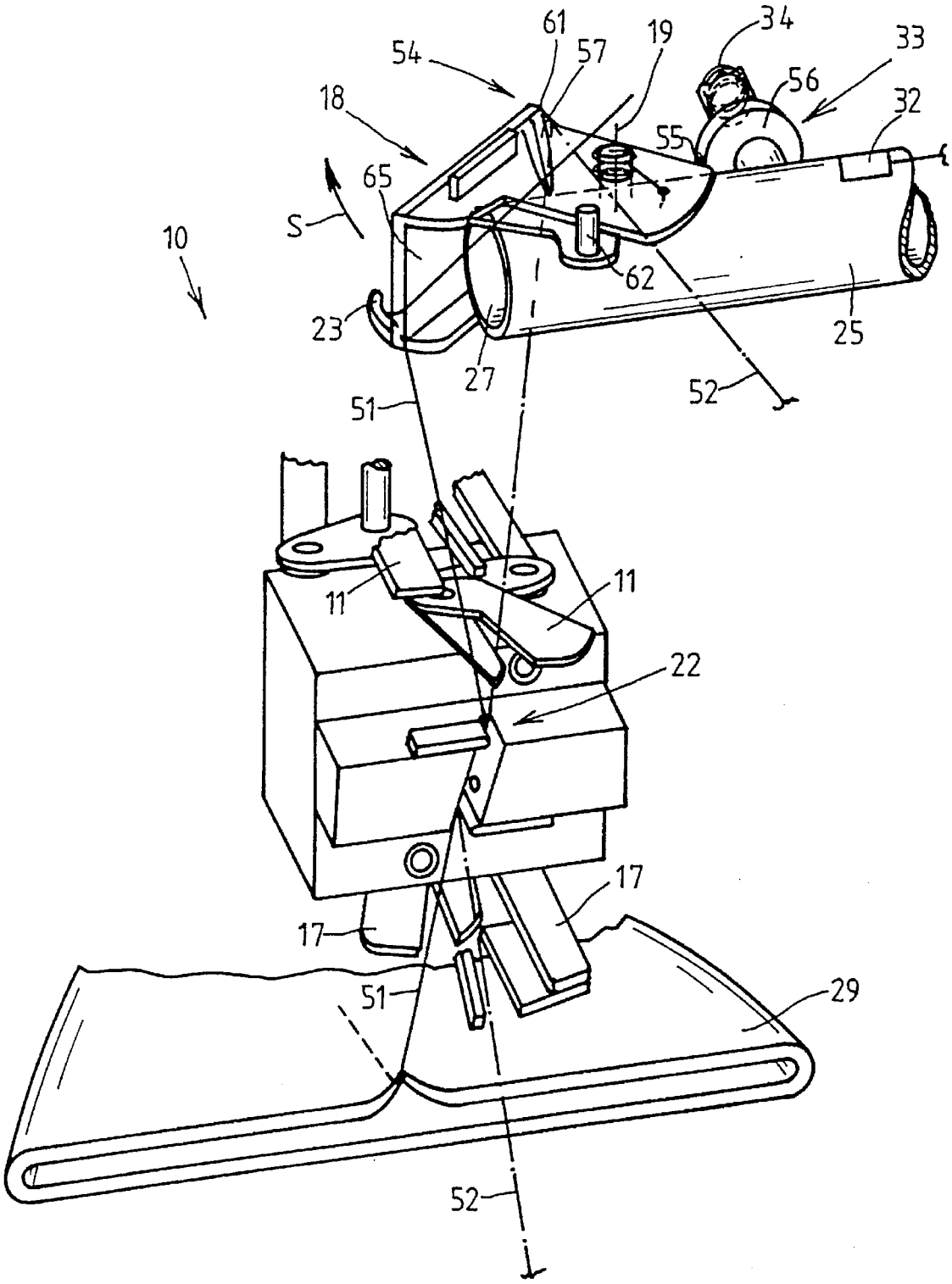
FIG. 2 is a front perspective view of the pneumatic yarn splicing device of FIG. 1, showing its gripper tube equipped according to the invention in its upper working position of FIG. 2.
Figure 5:
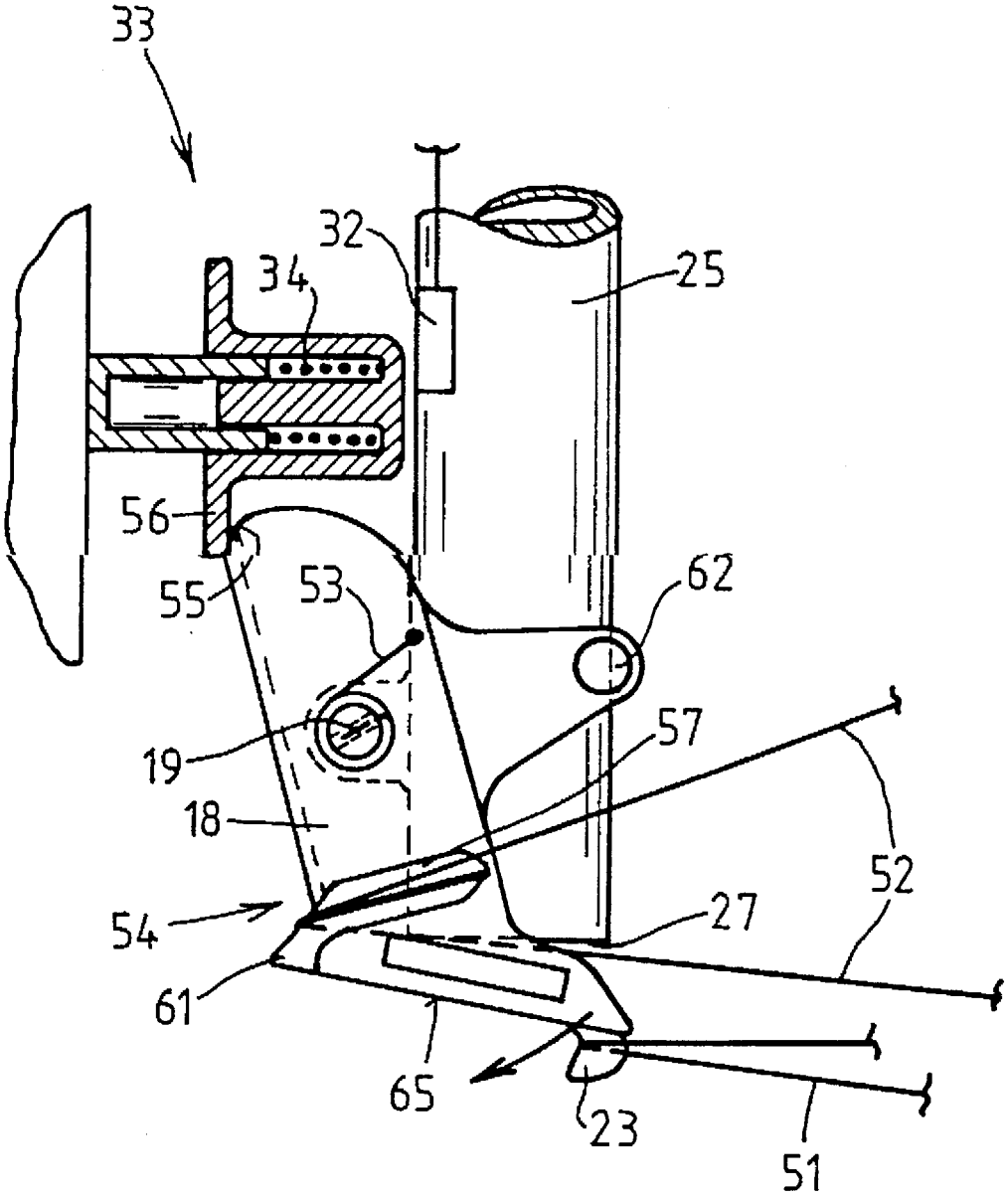
FIG. 5 is a plan view of the end region of the gripper tube of the splicer of FIGS. 2–4, viewed in the direction of the arrow V of FIG. 4.

A suction nozzle 29 is mounted to each winding station 2 via a suction connection 21 to the conduit 20, and a gripper tube 25 is similarly connected to the suction conduit 20 via a suction connection 24. The suction nozzle 29 is pivotably mounted so as to be pivotable to a limited extent about a pivot axis 31, and the gripper tube 25 is similarly supported for limited pivotable movement about a pivot axis 26. The free end of the gripper tube 25 has a gripper tube flap 18, which will be described later in further detail, in particular in conjunction with FIGS. 2 and 5.

The winder 1 shown in FIG. 1 is a so-called round magazine machine; that is, a feed cop changer identified generally at 36, is provided at each winding station 2, each feed cop changer having a round magazine 37 with a plurality of cop storage locations (preferably six) for replacement cops 38. In the present embodiment, two replacement cops 38 are shown, standing upright in the round magazine 37, with their yarn ends 39 retained in a central suction nozzle 40 of the round magazine 37. This suction nozzle 40 is likewise connected to the central suction conduit 20 via a suction tube 41. As shown in FIG. 1, the suction tube 41 simultaneously serves as a rotational axis supporting a bearing 42 for the rotational indexing movements of the round magazine 37. Below the round magazine 37, a cop chute 43 is disposed to receive a reserve cop when the magazine indexes the storage location of the affected cop into a discharge position 44, in the course of which an opening in the bottom wall of the magazine (not shown) is uncovered. With the aid of centering flanges 45 along the sides of the chute 43, the cop is then guided onto the arbor 3 which has been pivoted into a cop receiving position inclined toward the chute 43.

An auxiliary gripper 46 is also secured in the region of the cop chute 43 to be pivotable in the direction of the yarn tensioner 9, as represented by an arcuate line 47. After a cop change has taken place by discharge of a replacement cop from the magazine 37 into the chute 43, the leading yarn end 39 of the cop 38 still extends from the delivery position 5 on the arbor 3. The pivoting movement of the auxiliary gripper 46 is effective to place the length of the yarn end 39 in the operative range of the yarn tensioner 9.

As seen particularly from FIGS. 2–5, the gripper tube 25 has a gripper tube flap 18 supported on its end for limited pivotability about a pivot axis 19. A torsion spring element 53 is mounted about the pivot axis 19 and attached at its opposite ends to the gripper tube 25 and the gripper tube flap 18 to urge the gripper tube flap 18 in the direction of closure relative to the gripper tube mouth 27. The gripper tube flap 18 has a front plate 65 with a forwardly protruding yarn placement hook 23 and a yarn guide device 54 disposed between the yarn placement hook 23 and the pivot axis 19. The yarn guide device 54 essentially comprises a nose-like protrusion 61 protruding rearwardly in the flap pivoting direction S (FIG. 2), and a yarn guide contour 57 adjoining the protrusion and raised in ridge-like fashion.

The gripper tube flap 18 also has a control cam 62 in the form of a stub shaft fixed to an arm extending from the pivoted main body of the flap 18 (see FIGS. 2 and 5), which in combination with a control element 63 (FIG. 3) disposed in stationary fashion on the machine frame in the region of the yarn takeover position III of the gripper tube 25, assures a defined opening of the gripper tube flap 18.

Via a rearward engagement edge 55, the gripper tube flap 18 can also be opened in defined fashion in the region of the upper working position II of the gripper tube 25, upon striking a flange-like support element 56 of a spring-actuated stop 33 located in this region.

Figure 6:
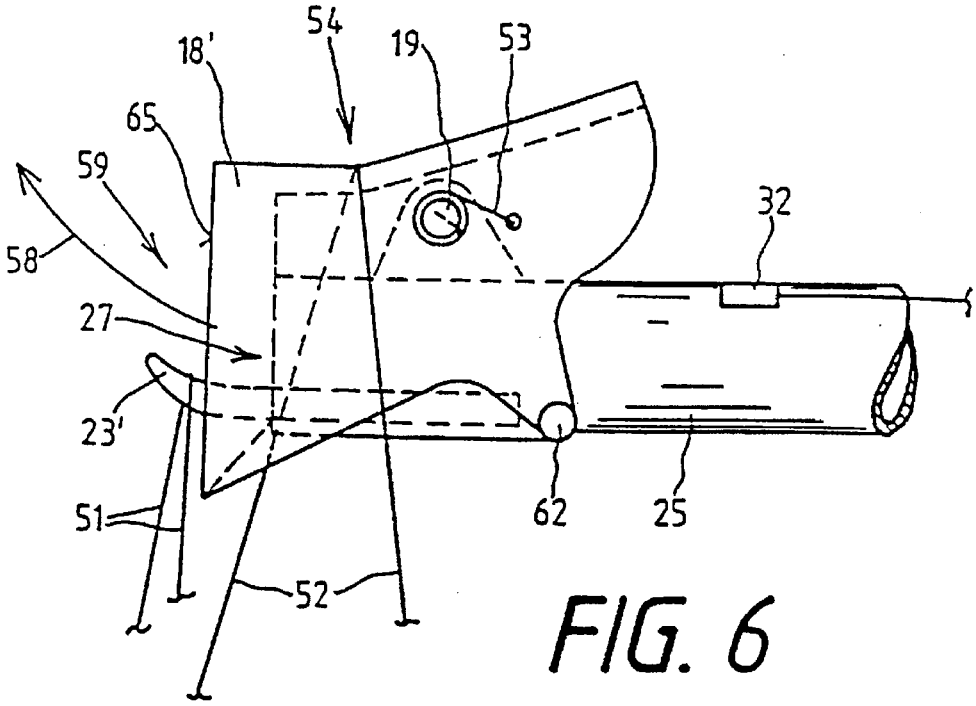
FIG. 6 is a plan view similar to FIG. 5, showing the end region of an alternative embodiment of the gripper tube at its gripper tube flap.
Figure 7:
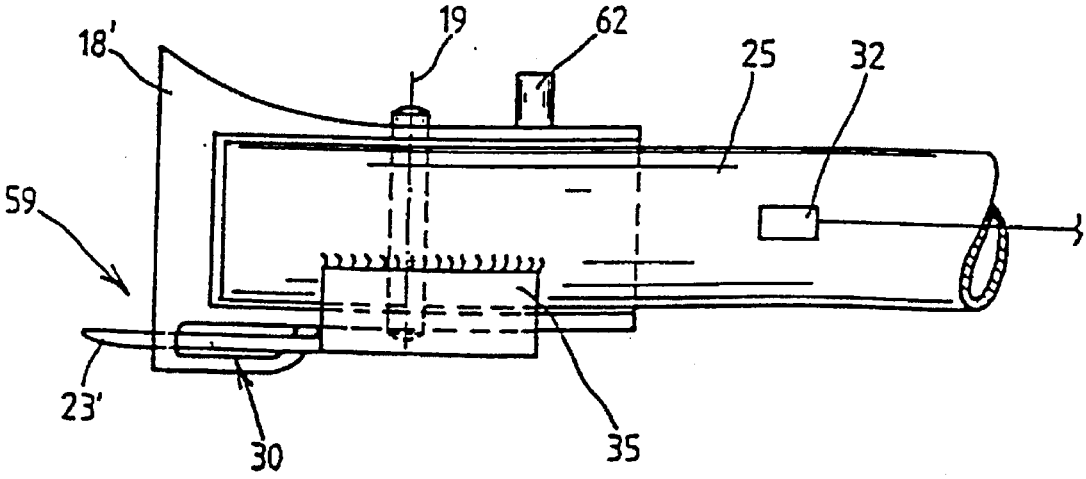
FIG. 7 is a front elevation of the end region of the gripper tube of FIG. 6.

Another advantageous alternative embodiment of the gripper tube flap is shown in FIGS. 6 and 7, wherein the gripper tube 25 is equipped with a yarn placement hook 23' fixed directly to the gripper tube 25 to extend axially outwardly relative to the gripper tube 25.

In this variant embodiment as well, the gripper tube 25 has a gripper tube flap 18' which is supported for limited pivoting about the pivot axis 19 and is biased via a spring element 53 into a normally closed disposition with its front panel 65 covering the gripper tube mouth 27. In addition, however, the gripper tube flap 18' has a slit-like opening 30, through which the yarn placement hook 23 extends. As in the embodiment described above, a control cam 62 is disposed on the gripper tube flap 18, by means of which the gripper tube flap 18' is pivoted in the direction of the arrow 58 upon arrival at a control element 63 disposed in the yarn receiving position III. Upon pivoted opening of the gripper tube flap 18' outwardly from the tube mouth 27, the yarn placement hook 23 is automatically cleared of any yarn loops or the like that may be present.

Figure 3:
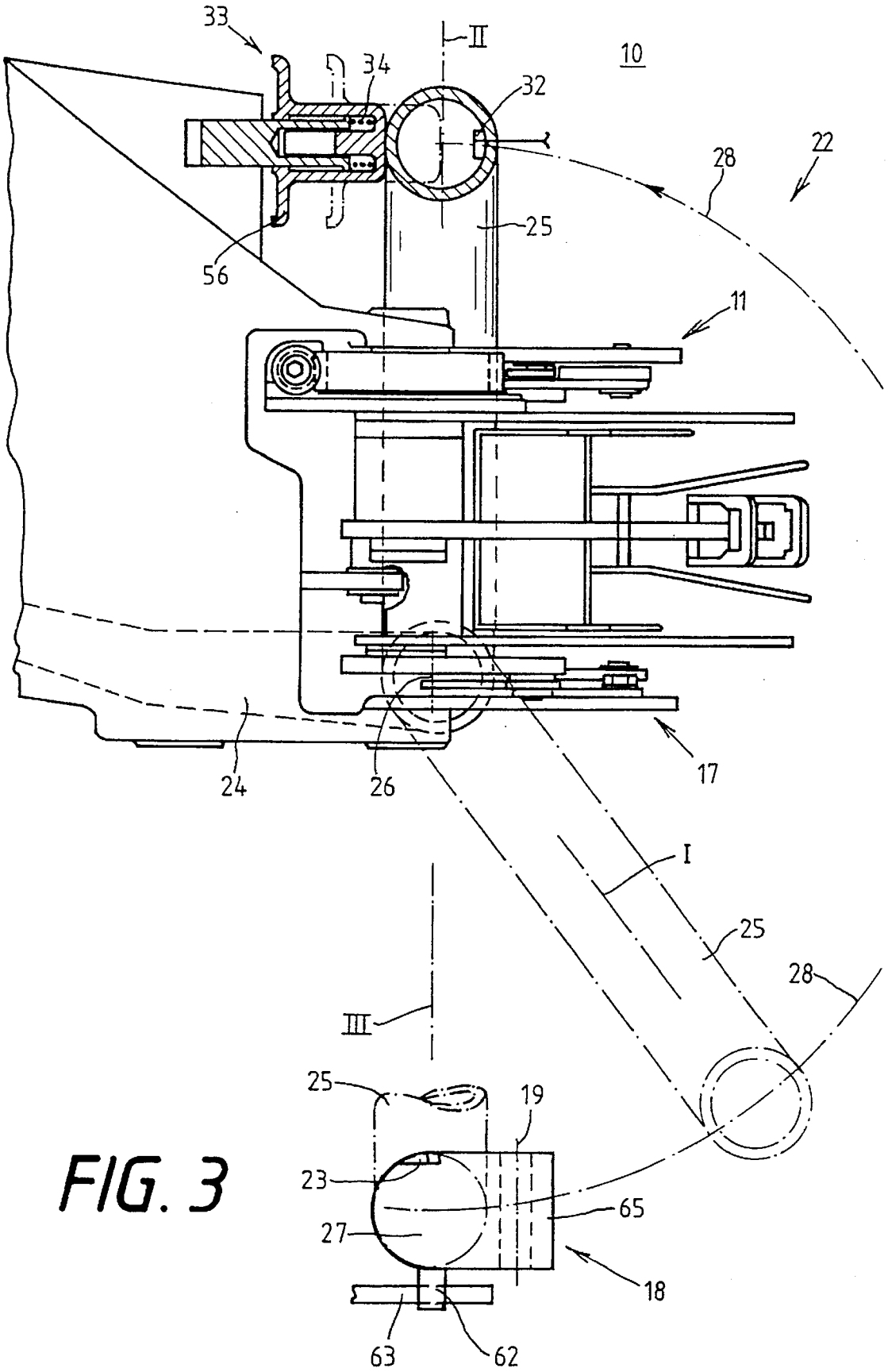
FIG. 3 is a side elevation of the pneumatic splicer of FIG. 2 showing the gripper tube positioned in its various operative positions.
Figure 4:
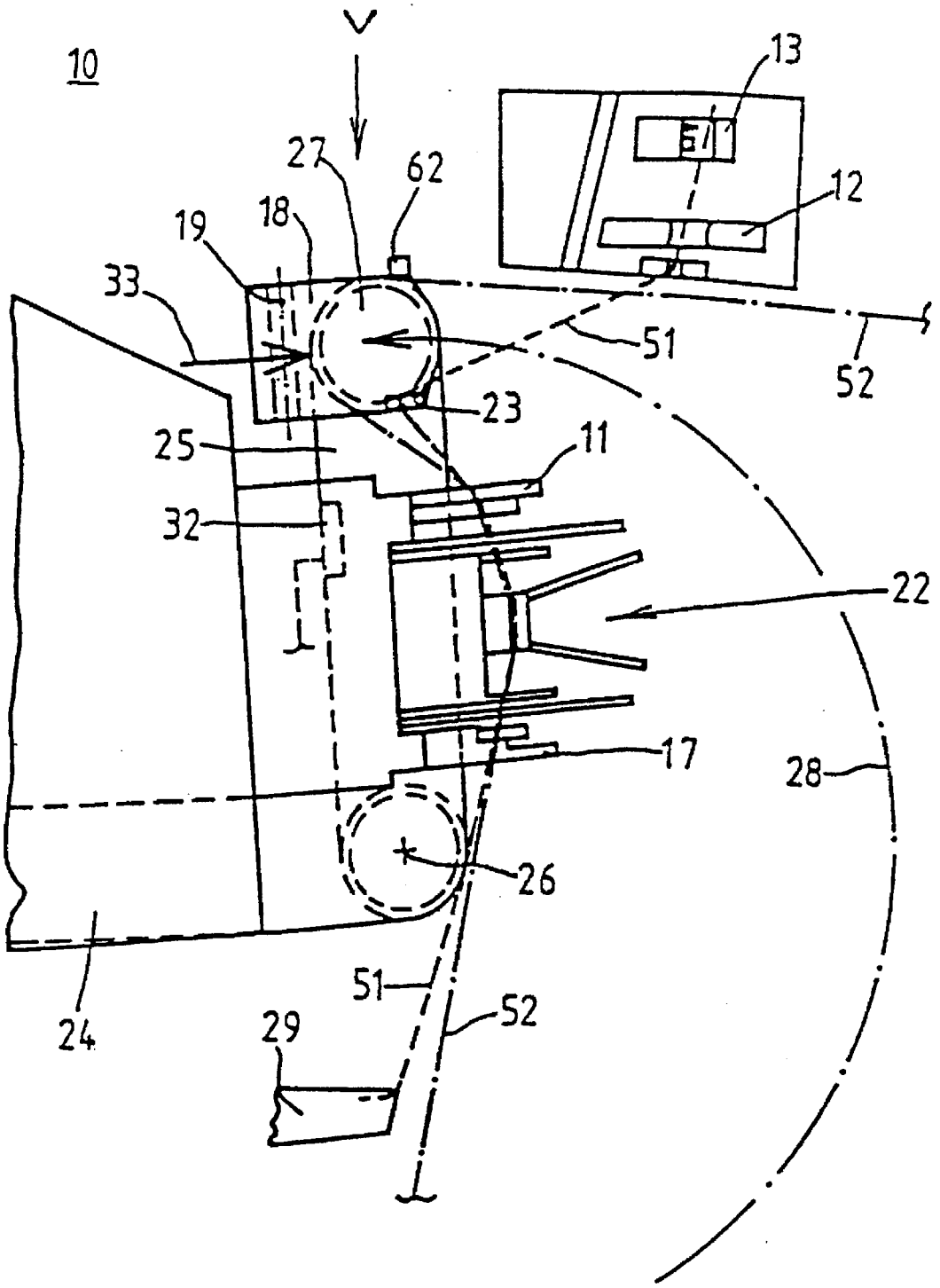
FIG. 4 is another side elevation of the splicer, somewhat schematic in relation to FIG. 3, showing the course of yarn travel of the upper and lower yarns with the gripper tube in its terminal upper working position.

Normal operation of the present splicing device may thus be understood. Upon any cessation of the normal yarn winding travel from a spinning cop 5 on the arbor 3 to the bobbin 15, e.g., because the spinning cop 5 positioned in the delivery unit 48 on the arbor 3 has run out of yarn or a yarn break occurs or any other event causing the dynamic and the static yarn signals from the electronic cleaner 12 to cease, then a cop change is initiated via the computer controller 64 of the affected winding station 2. The suction nozzle 29 is first pivoted to the vicinity of the surface of the bobbin 15, which revolves slowly counter to the winding direction, and engages the upper yarn 51 by suction. Next, the suction nozzle 29 pivots into its lower working position and in the process places the upper yarn 51 from the bobbin 15 in the cleaner 12, the clamping and cutting device 13, and an opened clamping and cutting device 17 located below the splicer 22. Thereafter, a cop change takes place by expelling the empty tube 49, or the feed cop 5 with residual yarn that cannot be further unwound without special preparation, from the arbor 3 within the delivery unit 48 onto a conveyor belt 50 for removal. Next, the round magazine 37 of the changer 36 is rotatably indexed to move one of the reserve cops 38 into the discharge position 44 of the round magazine for delivery via the aforementioned opening located in the magazine bottom and via the cop chute 43 and the centering flanges 45 onto the arbor 3 which has been pivoted to a receiving position aligned with the chute 43. Thereafter, the arbor 3 with the new feed cop 5 is pivoted back into the unwinding position. The end 39 of the yarn on the feed cop 5, which as aforedescribed is retained in the central suction nozzle 40 of the round magazine 37 to form a length of lower yarn 52, is then moved laterally in the direction of the yarn tensioner 9 by means of pivoting movement of the auxiliary gripper 46 and is held at the yarn tension 9. At the moment of the cop change, the gripper tube 25, as indicated in FIGS. 1 and 3, is in a starting "zero" position I forwardly, i.e., outwardly, of the regular course of yarn travel. Once the new feed cop 5 has been put in place, the gripper tube 25 pivots into an upper working position II whereby the gripper tube mouth 27 follows an arcuate path 28 in this process. The gripper tube flap 18 at the gripper tube mouth 27 remains closed by the biasing action of the spring element 53. During this movement, the gripper tube flap 18 engages the lower yarn 52 with the yarn guide device 54 on the flap 18 and displaces the yarn in the direction of the splicer 22 while the lower yarn 52 continues to be held taut via the suction nozzle 40 in the round magazine 37. Since the arcuate path 28 also intersects the path of the upper yarn 51, the upper yarn 51 is likewise engaged, either with the yarn placement hook 23' disposed on the gripper tube 25 (in the embodiment of FIGS. 6 and 7) or with the yarn placement hook 23 disposed on the gripper tube flap 18 (in the embodiment of FIGS. 2–5), and is likewise displaced in the direction of the splicer 22. The upper yarn 51 continues to be held in the process in the suction nozzle 29 in the downwardly pivoted position below the splicer 22.

By means of the yarn guide device 54 disposed on the gripper tube flap 18, the pivoting movement of the gripper tube 25 into its working position II positions the lower yarn 52 both in the clamp of the clamping and cutting device 17 disposed below the splicer 22 and in the scissors of the clamping and cutting device 11 disposed above the splicer 22. At the same time, the upper yarn 51 carried along by the yarn placement hook 23 is threaded into the upper clamping device 11. The aforementioned stop 33 equipped with a spring element 34 is mounted in the region of the upper working position II of the gripper tube 25. Shortly before the gripper tube 25 strikes this stop 33, the engagement edge 55 disposed on the gripper tube flap 18 initially contacts a flange element 56 on the stop 33. As a result, the gripper tube flap 18 is pivoted slightly about its pivot axis 19 to slightly open the gripper tube flap 18. As the gripper tube flap opens, it causes the two lengths of upper and lower yarns to come apart, i.e., the lower yarn 52 is moved somewhat rearwardly away from the gripper tube mouth 27, and the upper yarn 51 is moved forwardly away from the gripper tube mouth, resulting in a separation of the yarns 51, 52 that initially were parallel in the upper clamping and cutting device 11.

The flange element 56 is disposed a predetermined distance behind the head portion of the stop 33 such that, as the gripper tube 25 approaches, initially only the gripper tube flap 18 is affected and is pivoted somewhat in the process. Since the spring element 53, which acts upon the gripper tube flap in the closure direction has a softer spring characteristic curve than the spring element 34 of the stop 33, it is assured that the extent of opening of the gripper tube flap 18, which is predetermined by the spacing between the stop head and the support element, will reliably be reached and will not be changed during the continued approach of the gripper tube 25 to the stop 33.

By means of the spring-loaded stop 33, all the mechanical, drive-dictated actions of the gripper tube 25, which is driven via a cam disk, toothed lever and pinion (none of which are shown) are eliminated. As a result, the gripper tube 25 always enters an exactly defined upper working position II, so that the upper yarn 51 and the lower yarn 52 are always placed at the same depth and at the same wrap angle into the splicer 22.

Instead of the stop 33, a control slit (not shown) may be disposed in the region of the upper working position II of the gripper tube 25. In that case, in the working position II, the gripper tube flap 18 is pivoted open in a defined fashion, via the control cam 62, until it reaches a predetermined position. The upper yarn 51, however, remains wrapped around the yarn placement hook 23.

The yarns 51,52 fixed in the upper and lower clamping and cutting devices 11, 17 are then cut. The severed extent of the lower yarn is disposed of via the central suction nozzle 40 in the round magazine 37. The ridge-like yarn guide device 54 disposed on the gripper tube flap 18 then assures that the remainder of the lower yarn cannot also be engaged by the suction present in the mouth 27 of the gripper tube 25. The cut extent of the upper yarn is similarly disposed of through the suction nozzle 29 parked below the splicer 22.

Thereafter, the splicing operation takes place in a known manner which therefore is not described in detail here. After the splicing operation, the upper yarn (now joined to the lower yarn) continues to be located behind the yarn placement hook 23 that axially protrudes beyond the gripper tube flap 18. During restarting of the winding station 2, the gripper tube 25 slowly pivots in the direction of its original "zero" position (I). In the process, the yarn is returned to its regular path without tangling.

The above discussion essentially describes the functional procedure in the case of a cop changing operation. In the event of a typical "normal" yarn break, a somewhat modified functional procedure results. When a "normal" yarn break occurs, the absence of a dynamic yarn signal causes the yarn cleaner 12 to actuate the yarn clamping function of the yarn tensioner 9, whereby the lower yarn 52 from the cop 5 is retained in the yarn tensioner 9.

While the upper yarn 51, as described above, is engaged by the suction nozzle 29 at the cone 15 and placed in the region of the splicer 12, the lower yarn 52, retained in the yarn tensioner 9, is pneumatically retrieved by the gripper tube 25 by pivoting from its original zero position I initially rearwardly to the yarn receiving position III located in the region of the yarn tensioner 9 (FIGS. 1 and 3). A control element 63 is mounted in the region of the yarn receiving position III in position to engage the control cam 62 and thereby opens the gripper tube flap 18. At the same time, the yarn tensioner 9 is opened, so that the end of the lower yarn 52 is aspirated into the mouth region 27 of the gripper tube 25. Once the presence of the lower yarn 52 has been detected by means of a sensor 32 within the gripper tube 25, the gripper tube 25 with the aspirated lower yarn 52 pivots in the direction of its upper working position II. As the gripper tube 25 pivots away, the control cam 62 disposed on the gripper tube flap 18 slides away from the control element 63, so that the gripper tube flap 18 closes under the influence of the spring element 53 incorporated between the gripper tube 25 and the gripper tube flap 18, thereby clamping the lower yarn 52. The clamping of the lower yarn 52 between the gripper tube flap 18 and the gripper tube 25 is especially advantageous when troublesome yarns are being processed, because with such yarns, it is often problematic to carry them along by purely pneumatic means alone. The mechanical clamping by the gripper tube flap assures secure yarn carrying even with relatively inflexible yarns.

The further functional operation of the present invention in response to a yarn break circuit is essentially equivalent to that described above during a cop changing operation. Only the manner in which the lower yarn 52 is tautened and the cut lower yarn remainder is disposed of differ. Upon the movement of the gripper tube 25 into its upper working position II, i.e., upon the approach of the gripper tube 25 to the stop 33 or a corresponding control element (not shown), the gripper tube flap 18 is pivoted slightly in the opening direction, as described above. The yarn, which theretofore had been initially mechanically clamped, is released in the process and tautened by the suction prevailing in the gripper tube 25. The disposal of the severed extent of the lower yarn is effected not via the suction nozzle 40 of the round magazine 37 but rather directly via the gripper tube 25.

In the event of yarn breaks following the splicing operation, especially if the yarn breaks occur above the splicer 22, it can occur that the yarn end joined to the feed cop 5 that is aspirated into the gripper tube 25 will wrap in a loop around the yarn placement hook 23, which causes a disruption at the affected winding station.

In the embodiment of FIGS. 6 and 7, the occurrence of such disruptions is prevented by providing that the gripper tube 25, when pivoting forward in the direction of the arrow 58 with its slit-like opening 30 fitting with close tolerances over the yarn placement hook 23, automatically cleans the yarn placement hook 23 when the gripper tube 25 pivots into the yarn receiving position III. More specifically, when the control cam 62 of the gripper tube 25 strikes a control stop 63 located in this region, the ensuing outward pivoting of the gripper tube flap frees the entire yarn placement hook 23 of any yarn loops that may be on it.

As persons skilled in the art will understand, the present invention is not intended to be limited to the exemplary embodiments described. For example, in further embodiments of the invention it is also possible to dispense with a gripper tube flap entirely, and to engage the upper yarn with a pin protruding laterally past the edge of the gripper tube rather than with a yarn placement hook disposed on the gripper tube flap. In that case, the flow of suction of the gripper tube must be regulated via an air slide screen.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A yarn splicing device for use with textile winding machines which produce cross-wound bobbins, comprising:

a splicer disposed outside a normal path of yarn winding travel for pneumatically joining ends of first and second yarns, means for clamping and cutting the yarn ends to be spliced in the region of the splicer, suction-actuated yarn placing means for positioning with respect to the splicer the yarn ends to be spliced, and means for inserting the yarn ends into the splicer, wherein the yarn placing means comprises a gripper tube for engaging a first yarn to be spliced, the gripper tube having one end thereof disposed for pivotable movement within an operative range including a terminal position above the splicer whereat the first yarn, when engaged by the end of the gripper tube, is positioned properly in the splicer, and wherein the end of the gripper tube includes a carrier means for engaging the second yarn during the operative movement of the gripper tube for carrying the second yarn into proper position in the splicer when the gripper tube moves to the terminal position above the splicer.

2. The yarn splicing device for use with textile machines according to claim 1, wherein the end of the gripper tube includes a gripping flap and a yarn placement hook which extends axially outwardly from the gripper tube forwardly of the gripping flap.

3. The yarn splicing device for use with textile machines according to claim 1, wherein said first yarn is a bottom yarn and said second yarn is a top yarn.

4. A yarn splicing device for use with textile winding machines which produce cross-wound bobbins, comprising:

a splicer disposed outside a normal path of yarn winding travel for pneumatically joining ends, means for clamping and cutting yarn ends to be spliced in the region of the splicer, suction-actuated yarn placing means for positioning the yarn ends to be spliced, and means for inserting the yarn ends into the splicer, wherein the yarn placing means comprises a gripper tube for engaging a first yarn to be spliced, said gripper tube being disposed for movement within an operative range including a terminal position whereat said first yarn when engaged by said gripper tube is positioned properly in the splicer, said gripper tube having a carrier means for engaging a second yarn to be spliced with the first yarn during said operative movement of said gripper tube and for carrying said second yarn into proper position in the splicer when said gripper tube moves to said terminal position, and wherein said gripper tube has a spring-biased gripping flap pivotally affixed about a pivot axis to one end of said gripper tube and said carrier means comprises a yarn placement hook disposed on said gripping flap.

5. The yarn splicing device for use with textile machines according to claim 4, wherein the gripping flap has a yarn guide portion disposed between the pivot axis of the gripping flap and the yarn placement hook.

6. The yarn splicing device for use with textile machines according to claim 5, wherein the yarn guide portion has a nose extending beyond the gripping flap in a pivoting direction of the flap and a yarn guide contour adjoining the nose.

7. The yarn splicing device for use with textile machines according to claim 4, wherein the gripping flap includes a spring element biasing the gripping flap into a closed position, the spring element being disposed between the gripping flap and the gripper tube in the region of the pivot axis of the gripping flap.

8. The yarn splicing device for use with textile machines according to claim 4, further comprising a control cam disposed on the gripper tube and a control element disposed in the region of a yarn transfer position of the gripper tube for acting upon the control cam.

9. A yarn splicing device for use with textile winding machines which produce cross-wound bobbins, comprising:

a splicer disposed outside a normal path of yarn winding travel for pneumatically joining ends, means for clamping and cutting yarn ends to be spliced in the region of the splicer, suction-actuated yarn placing means for positioning the yarn ends to be spliced, and means for inserting the yarn ends into the splicer, wherein the yarn placing means comprises a gripper tube for engaging a first yarn to be spliced, said gripper tube being disposed for movement within an operative range including a terminal position whereat said first yarn when engaged by said gripper tube is positioned properly in the splicer, said gripper tube having a carrier means for engaging a second yarn to be spliced with the first yarn during said operative movement of said gripper tube and for carrying said second yarn into proper position in the splicer when said gripper tube moves to said terminal position, and wherein a spring-biased stop is disposed in the region of the terminal position of said gripper tube for contacting said gripper tube.

10. The yarn splicing device for use with textile machines according to claim 9, wherein the gripper tube includes a spring-biased gripping flap having an edge and the stop includes a flange disposed for corresponding engagement with the edge of the gripping flap when the gripper tube approaches the terminal position.

11. The yarn splicing device for use with textile machines according to claim 10, further comprising a first spring element disposed between the gripper tube and the gripping flap, and wherein the stop comprises a second spring element having a harder spring characteristic curve than the first spring element incorporated between the gripper tube and the gripping flap.

12. A yarn splicing device for use with textile winding machines which produce cross-wound bobbins, comprising:

a splicer disposed outside a normal path of yarn winding travel for pneumatically joining ends, means for clamping and cutting yarn ends to be spliced in the region of the splicer, suction-actuated yarn placing means for positioning the yarn ends to be spliced, and means for inserting the yarn ends into the splicer, wherein the yarn placing means comprises a gripper tube for engaging a first yarn to be spliced, said gripper tube being disposed for movement within an operative range including a terminal position whereat said first yarn when engaged by said gripper tube is positioned properly in the splicer, said gripper tube having a carrier means for engaging a second yarn to be spliced with the first yarn during said operative movement of said gripper tube and for carrying said second yarn into proper position in the splicer when said gripper tube moves to said terminal position, and wherein the gripper tube has a yarn placement hook extending beyond a mouth opening of said gripper tube and a movable cleaning device for sweeping over the yarn placement hook.

13. The yarn splicing device for use with textile machines according to claim 12, wherein the cleaning device comprises a gripping flap pivoted to the gripper tube for movement outwardly from the mouth opening of the gripper tube.

14. The yarn splicing device for use with textile machines according to claim 13, wherein the yarn placement hook is stationary relative to the gripper tube and the pivotable gripping flap has a slit-like opening for surrounding the yarn placement hook.

* * * * *